US005231704A

United States Patent [19]

Hildenbrand

[11] Patent Number: 5,231,704

[45] Date of Patent: Aug. 3, 1993

[54] ATTACHABLE EAR PROTECTION

[76] Inventor: Francis J. Hildenbrand, 48 Birch Hill Dr., Poughkeepsie, N.Y. 12603

[21] Appl. No.: 959,410

[22] Filed: Oct. 13, 1992

[51] Int. Cl.[5] ..... A42B 1/06

[52] U.S. Cl. ..... 2/423; 2/199; 2/209; 2/421

[58] Field of Search ..... 2/199, 209, 421, 423, 2/425

[56] References Cited

U.S. PATENT DOCUMENTS

| | | | |
|---|---|---|---|
| 2,991,478 | 7/1961 | Zbikowski | 2/421 |
| 3,239,842 | 3/1966 | Marchello | 2/423 |
| 3,497,874 | 3/1970 | Molitoris | 2/423 |
| 4,670,911 | 6/1987 | Dunford | 2/423 |
| 5,046,193 | 9/1991 | Foresman | 2/423 |

*Primary Examiner*—Clifford D. Crowder
*Assistant Examiner*—Diana L. Biefeld

[57] ABSTRACT

An ear protection device, intended to be worn as a pair, for attachment to the chin straps of helmets and being of minimum weight and bulk and used to protect the ear from cold, wind chill, wind noise and abrasion without compromising sound reception by the ear. The ear protection device comprises a covering member which is positioned on or around the chin straps and in contact with the bottom edge of the helmet. Thus being positioned over the ear, the fastening or coupling member is engaged holding the cover in place over the ear.

6 Claims, 2 Drawing Sheets

ATTACHABLE EAR PROTECTION

BACKGROUND OF THE INVENTION

1. Field of the Invention

This invention relates in general to a protective ear covering which may be attached to and suspended by the chin straps of helmets. More particularly, the present invention relates to protective ear coverings which utilize the chin strap of a helmet to be directly coupled or indirectly coupled into place over the ear.

2. Background Information

In order to provide background information so that the invention may be completely understood and appreciated in its proper context, reference may be made to a number of prior art patents and publications as follows:

U.S. Pat. No. Des. 276,855 is an earmuff cup design, beveled on its exterior to provide a cup into which an earmuff could be placed. It protrudes from the head, forming its highest point at its midpoint.

U.S. Pat. No. 3,943,574 is a ski mask which includes bowl shaped ear protectors on which the ski mask rests. The ear bowls are joined by an overhead strap and serve to hold the face mask to the head.

U.S. Pat. No. 3,796,855 disclosed ear heating pads which are connected by wiring to either house current or portable battery pack.

U.S. Pat. No. 2,693,559 discloses an ear muff device which comprises a pair of ear coverings supported on a head band. This and similar types of ear muff devices utilize the top of the head to support a flexible band which permits the ear muffs to hand down and position over the ears.

U.S. Pat. No. 1,468,556 suggests that the ear covering be attached directly to the ear. The design is focused only on protecting from object intrusion or loud sound.

U.S. Pat. No. 1,621,629 discloses a protective covering which can be attached to a support arm of safety goggles. The covering is not adopted for protection against cold temperatures.

U.S. Pat. No. 2,333,392 discloses an ear covering which is suspended from the support structure of a hat band.

U.S. Pat. No. 2,593,892 discloses another kind of ear covering to prevent access of water such as occurs when swimming.

U.S. Pat. No. 3,823,713 discloses a unique configuration for an ear covering for medical purposes. It is attached directly to the ear and does not involve the use of support structure.

U.S. Pat. No. 4,670,911 describes a protective ear covering which may be attached and suspended from the head strap of ski goggles or to the retaining arms of eye glasses.

U.S. Pat. No. 4,682,374 describes ear protectors that are constructed to enable them to be fastened to goggle straps or the temple pieces of ski goggles or to fabric headbands.

Whatever the precise merits, features and advantages of the above cited references, none of the prior art accomplishes, achieves or fulfills the objectives that the ear protectors of the present invention accomplishes. For example, protecting ears from the cold during intense physical activity such as experienced during bicycle training or riding presents unique problems which are not satisfactorily addressed by prior art. Such an environment requires that the ears be protected without creating overheating problems with the head itself since it is the most important body heat regulator. Attempts to achieve this objective by the above prior art have resulted in complex contraptions which are bulky of their nature. Further, some of the solutions are such that they create a sizing problem for the common safety helmets including sports helmets. Some of the cited prior art is unacceptable in that it is not designed to provide abrasion protection and, in fact, in case of an accident could cause injuries to the ear and head themselves.

What is needed is a more adaptable and broader solution which can be used in combination with a helmet, easily installed, carried, portable to other helmets, free of complexity and bulk and focused in its protection. Further, the device should be able to attenuate wind noise while allowing the passage of sounds necessary for safety.

None of the prior art addresses the helmet strap attachment design of this invention nor do they adequately achieve all of the aforementioned objectives.

SUMMARY OF THE INVENTION

It is therefore an object of the present invention to provide a form of ear protector which is attachable directly to the chin straps of a helmet.

It is a further objective of this invention to provide such an ear protector which by the nature of its attachment to the chin straps of a helmet is positioned and secured over the ear to fully protect the ear from cold temperature and abrasion.

Another objective of this invention is to provide a device which is easily installed, removed or easily transferred to another helmet.

A still further objective of this invention is to provide a device which has negligible weight and bulk.

A still further objective of this invention is to provide a device that while providing thermal protection for the ears will not affect any other part of the body's ability to dissipate heat.

A still further objective of this invention is to provide ear protection without affecting or comprising the fit or comfort of the helmet to the wearer.

A still further objective of this invention is to provide an ear protector that is non-restrictive.

A still further objective of the invention is to reduce the negative effect of wind noise without interfering with the reception of normal and essential sounds.

These and other objects are realized in an ear protective device for attachment to the chin straps of a helmet. The device comprises a compliant material configured to a truncated cone consistent with the area that the ear occupies between the chin strap of a helmet. This structure is slipped over the chin strap and fixed into position over the ear because of its orientation on the chin straps.

These and other objects will be more readily ascertainable to one skilled in the art from a consideration of the following Figures, description and exemplary embodiments.

DESCRIPTION OF PREFERRED EMBODIMENTS

Figure 1:
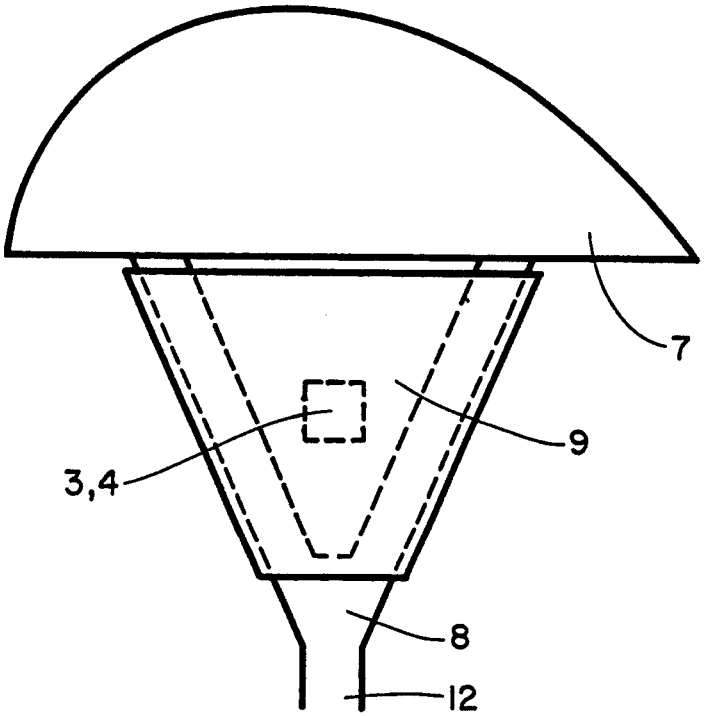
FIG. 1 illustrates the ear protector, this invention, installed on the chin strap of a helmet.

Referring now to the drawings:

The preferred embodiment of the ear protective device is shown as item 9 in FIG. 1 in a supported position on the chin strap of a helmet 7. While the following description and figures will detail the ear protector, it is pointed out that the device is naturally intended to be used as a pair, one over each ear. Further, note that this device could be utilized on any helmet with chin straps.

Ear protector 9 is shaped and sized to correspond to the design of the helmet and its chin strap configuration resulting in the proper positioning and close overfit of the device to the ear.

This capitalization of the chin strap orientation in a Y configuration, passing on both the front and the rear of the ear is one aspect that makes this device unique.

The ear of the wearer is protected within the contained area between the chin straps bounded by the bottom edge of the helmet, the arms of the Y and the vertex of the Y where the arms meet the stem. Accordingly, the device covers the ear affording protection from abrasion and cold including the negative effects of wind chill. Additionally, the design of the device places the ear protection over the ear without encasing the ear allowing normal sound reception yet muting the negative effect of disturbing wind noise. This design objective is an important safety feature to, for example, a bicyclist who will be able to better isolate important traffic noise or a construction worker who will be better able to hear instructions and warnings.

All the objectives of the invention are achieved throughout a wide range of ambient temperatures without bulk and without overheating other parts of the head. The device is practically weightless and non-restrictive. Note that for illustrative purposes, some small space is shown between the ear protector, item 9, and the lower edge of the helmet, item 7. The normal positioning of the ear protector would be flush with the bottom edge of the helmet.

Figure 2:
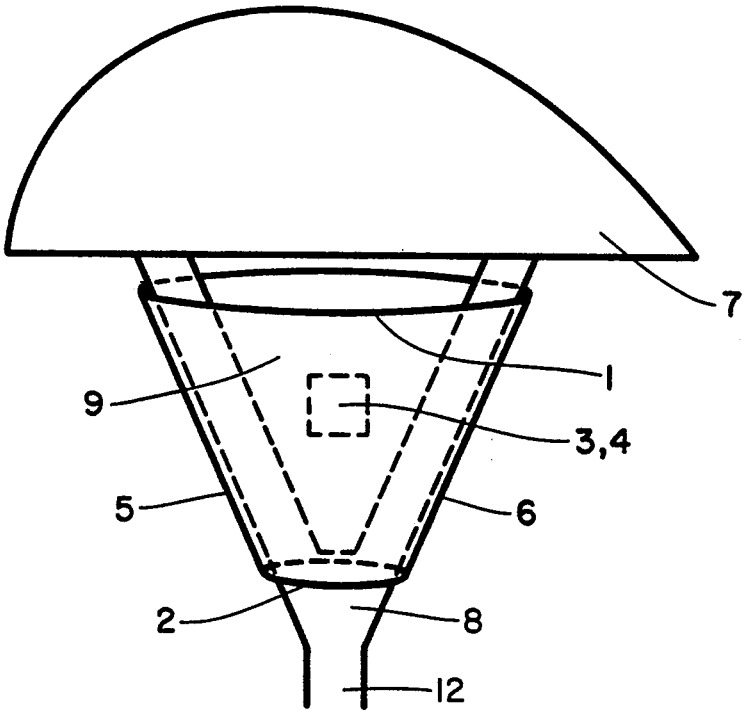
FIG. 2 is an isometric view of the preferred construction of the ear protector.

FIG. 2 is an isometric illustration of the preferred construction of the device. It shows the device, item 9, to be a truncated conical shape of sufficient size to span the chin strap separation from front to rear and to span from the bottom of the helmet to the vertex, item 8, formed by the front and rear straps meeting below the ear to a single strap going under the chin, item 12. Edge 1 is designed to be in close proximity to the bottom edge of the helmet. Edge 2 is designed to cover the vertex of the front and back straps, item 8. Items 3 and 4 represent the male and female portions of a fastener or coupler respectively. The coupler is positioned on the inside opposite surfaces of the ear protector such that it falls inside the Y made by the straps. When engaged, the coupler holds the ear protector in proper position on the supporting chin strap. The original conical shape of the ear protector is now flattened over the straps creating edges, items 5 and 6, and is in the form of a layer of material held against the users ear.

FIG. 2 can be used to describe the installation procedure. The ear protector fastener is disengaged. The loose end of the chin strap, item 12, is inserted into the top of the cover, item 1, and the ear protector is slid up the strap until it touches the bottom of the helmet. This places the fastener inside of the vertex of the Y where it is engaged with its mate. The device is now in position on the helmet.

Figure 3:
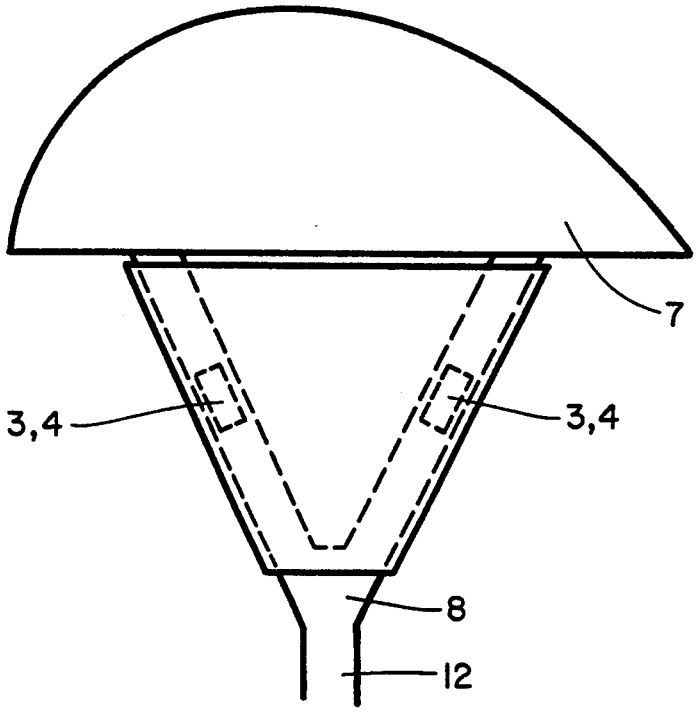
FIG. 3 illustrates an alternate construction of the ear protector.

FIG. 3 illustrates an alternate method of construction of the ear protector. Material is patterned and sized so that it spans the chin straps front to rear and overlaps them so that a fastener/coupler, item 3, installed on each of the front and the rear chin straps will engage the opposing mates, item 4, installed on the insides of the cover, front and rear. The cover is positioned over the ear as a single layer of material.

Figure 4:
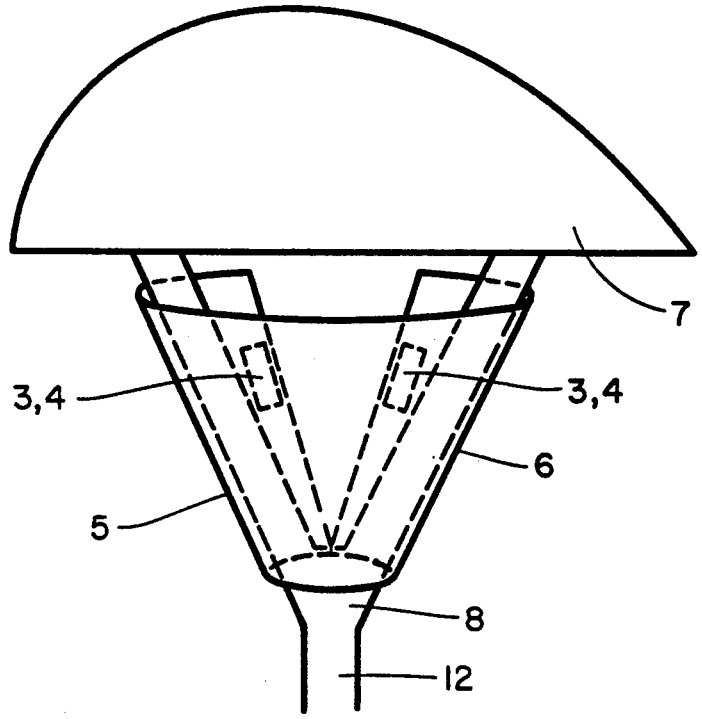
FIG. 4 illustrates another alternate construction of the device.

FIG. 4 illustrates another possible alternatives for construction. In this case, the conical shape is modified such that the cover is created as a less than a 360 degree cone. The resulting shape is of such a size that it can be wrapped around each of the front and rear chin straps with additional surface for affixing the coupling mechanism. The coupling mechanism, items 3 and 4, is affixed on the inside opposite surfaces of the cover such that when it is engaged it is not in interference with the straps. This now holds the cover in a flattened configuration, similar to the FIG. 2 description, in its proper position over the ear.

The illustrations of FIG. 1, FIG. 2 and FIG. 4 illustrate the preferred structures in that they allow the device to be utilized without any modifications to the chin strap or the helmet. This makes the device totally portable from helmet to helmet being self-contained by its design.

The construction of the device is comprised of materials such as polyester felt for the cover and pliable hook and loop type material for the fastener. The cover material selection would focus on comfort against the ear, compliance, durability, washability and insulating value. Any material that performs these functions is intended to be within the scope of this invention. In addition, the exterior surface of the ear protector may include design features which enhance the aesthetic appearance of the protector and provide an aspect of fashion to the wearer. The fastener solution could be any male/female arrangement of appropriate size and is not intended to be limited to hook and loop types.

It will be apparent to those skilled in the art that other embodiments can be adapted which incorporate the inventive principles disclosed herein. For example, the protector could have been constructed so that the fasteners were directly attached to the chin straps and the protector then could be a planar device that was merely applied as a single sheet across the straps. As with the preferred embodiment, the device utilizes the helmet chin straps too hold the device in contact with the wearer's ear achieving all of the previous objectives.

The ear protection device disclosed in the present invention provides numerous advantages over the prior art. It represents a fashionable form of ear covering (by selection of material fabric and color, embroidery, etc.) essentially integral with the helmet. It provides comfort and warmth with negligible weight and bulk of the typical ear covering such as stocking caps, ear muffs, head bands and ear encapsulation devices. Also, since the device is confined to the ear and only the ear, it does not cause overheating of any other part of the body which is a severe shortcoming of most traditional approaches to ear warming solutions. Further, it does not interfere with the sizing or fit of the helmet as the traditional approaches do. For example, a hood or head band must be accommodated under the helmet. These effectively increase the size of the head. The ear covering as the present invention is designed such that it does not interfere with normal hearing ability but it will reduce the interference of wind noise on the normal ability to hear. As an example, a bicyclist traveling at twenty miles per hour without this device will experience enough wind noise to mask some or all of the sound of approaching cars from his/her rear. This device, when installed, significantly reduces this wind noise allowing the wearer to hear the approaching traffic. Some of the prior art reviewed have totally surrounded the ear or encapsulated the ear inhibiting the wearer's ability to hear ambient sounds of safety importance.

In summary, this invention has many advantages:

It is adaptable to virtually any helmet with chin straps.

It provides natural ear warmth throughout a wide ambient temperature range.

It does not overheat any other part of the body.

It is self-storing as it becomes part of the helmet.

It has minimum weight and bulk.

It enhances hearing by reducing wind noise.

It protects the ear from possible abrasion in case of an accident.

It is unobtrusive by its design to become integral with the helmet yet the selection of materials and decorations will allow a fashion statement if desired.

Having now illustrated and described my invention, it is not my invention that such description limit the invention, but that the invention be limited only by a reasonable interpretation of the appended claims.

I claim:

1. An ear protection device intended to be worn as a pair for attachment to a helmet, said helmet having a structure of front and rear chin straps which drop from the bottom edge of said helmet and join at a point below the ear, said device for protecting the ear from cold, wind chill, wind noise and abrasion without compromising sound reception by the ear, said device comprising:

(a) a covering member shaped in the form of a truncated cone and sized to cover the area bounded by said front and rear chin straps and said bottom edge of said helmet, said front and rear chin straps positioned inside said covering member with the opposing interior surfaces of said covering member in juxtaposition over the wearer's ear;

(b) said covering member having coupling means located on each opposing interior side of said covering member so that said interior sides of said covering member are coupled together above said point where said front and rear chin straps join together thereby holding said covering member in proper position over the ear;

(c) said covering member fabricated of compliant, non-irritating, sound transmitting, durable, washable, insulating material.

2. An ear protection device according to claim 1, wherein said coupling means is comprised of cooperating surfaces oriented facing each other with one said surface carrying a plurality of small hook like members and the other said surface carrying a felt-like material, said surfaces engageable with each other.

3. An ear protection device intended to be worn as a pair for attachment to a helmet, said helmet having a structure of front and rear chin straps which drop from the bottom edge of said helmet and join at a point below the ear, said device for protecting the ear from cold, wind chill, wind noise and abrasion without compromising sound reception by the ear, said device comprising:

(a) a covering member shaped in the general form of a truncated triangle and sized to cover the area bounded by said front and rear chin straps and said bottom edge of said helmet, said front and rear chin straps coincident with the edges of said covering member with the interior surface of said covering member in juxtaposition over the wearer's ear;

(b) said covering member and said front and rear chin straps having a coupling means to attach said edges of said covering member to said front and rear chin straps above said point where said front and rear chin straps join together thereby holding said covering member in proper position over the ear;

(c) said covering member fabricated of compliant, non-irritating, sound transmitting, durable, washable, insulating material.

4. An ear protection device according to claim 3, wherein said coupling means is comprised of cooperating surfaces oriented facing each other with one said surface carrying a plurality of small hook like members and the other said surface carrying a felt-like material, said surfaces engageable with each other.

5. An ear protection device intended to be worn as a pair for attachment to a helmet, said helmet having a structure of front and rear chin straps which drop from the bottom edge of said helmet and join at a point below the ear, said device for protecting the ear from cold, wind chill, wind noise and abrasion without compromising sound reception by the ear, said device comprising:

(a) a covering member shaped in the general form of a truncated cone of less than 360 degrees, e.g. 270 degrees, and sized to cover the area bounded by said front and rear chin straps and said bottom edge of said helmet, said front and rear chin straps positioned inside said covering member with the interior surface of said covering member in juxtaposition over the wearer's ear;

(b) said covering member having coupling means to couple the opposing interior sides of said covering member together, said coupling means oriented on said covering member to line up with but clear the inside edges of said front and rear chin straps when said covering member is wrapped around said chin straps thereby holding said covering member in proper position over the ear;

(c) said covering member fabricated of compliant, non-irritating, sound transmitting, durable, washable, insulating material.

6. An ear protection device according to claim 5, wherein said coupling means is comprised of cooperating surfaces oriented facing each other with one said surface carrying a plurality of small hook like members and the other said surface carrying a felt-like material, said surfaces engageable with each other.

* * * * *